US006263176B1

(12) United States Patent
An et al.

(10) Patent No.: US 6,263,176 B1
(45) Date of Patent: Jul. 17, 2001

(54) APPARATUS FOR CLEANING TRANSFER ROLLER AND OPTICAL PHOTORECEPTOR OF PRINTING DEVICE

(75) Inventors: Hyung-jin An, Suwon; Kyu-cheol Shin, Kwacheon, both of (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/492,326

(22) Filed: Jan. 27, 2000

(30) Foreign Application Priority Data

Jan. 26, 1999 (KR) ..... 99-2402

(51) Int. Cl.[7] ..... G03G 21/00
(52) U.S. Cl. ..... 399/101
(58) Field of Search ..... 399/101, 307, 399/308, 302

(56) References Cited

U.S. PATENT DOCUMENTS 5,678,134 * 10/1997 Miki et al. ..... 399/71
5,732,310 * 3/1998 Hiroshima et al. ..... 399/101
5,732,314 * 3/1998 Tsukida et al. ..... 399/302
5,970,281 * 10/1999 Park ..... 399/101
6,026,271 * 2/2000 Saitoh ..... 399/308

FOREIGN PATENT DOCUMENTS 9-62111 * 3/1997 (JP) .
10-69146 * 3/1998 (JP) .
11-288183 * 10/1999 (JP) .

OTHER PUBLICATIONS

Abstract of Published Application JP 2000131962, May 12, 2000.*

* cited by examiner

*Primary Examiner*—William J. Royer
(74) *Attorney, Agent, or Firm*—Sughrue, Mion, Zinn, Macpeak & Seas, PLLC

(57) ABSTRACT

An apparatus for cleaning a transfer roller and an optical photoreceptor cleans the transfer roller for transferring a toner image formed on the optical photoreceptor of a printing device to a recording paper, and includes a cleaning roller installed to closely contact an outer circumferential surface of the transfer roller and to be rotatable; a heat source installed in the cleaning roller for heating an outer circumferential surface of the cleaning roller; and a cleaning roller moving mechanism which causes the cleaning roller either to contact or be separated from the outer circumferential surface of the transfer roller. In addition, the apparatus further includes a waste ink mechanism which removes waste ink on the outer circumferential surface of the cleaning roller, and a discharge mechanism which discharges the removed waste ink. Therefore, after waste ink remaining on the optical photoreceptor is transferred to the transfer roller, the waste ink remaining on the outer circumferential surface of the cleaning roller can be removed, and the waste ink moving and adhering to the outer circumferential surface of the cleaning roller can be removed.

16 Claims, 6 Drawing Sheets

APPARATUS FOR CLEANING TRANSFER ROLLER AND OPTICAL PHOTORECEPTOR OF PRINTING DEVICE

BACKGROUND OF THE INVENTION

1. Field of the Invention

The present invention relates to a printing device such as a printer or copier and, more particularly, to an apparatus for cleaning a transfer roller and an optical photoreceptor of a printing device, which is intended to clean the transfer roller for transferring a toner image formed on the optical photoreceptor to a recording paper.

2. Description of the Related Art

In general, a printing device such as a printer or copier is an apparatus which forms a latent electrostatic image on an optical photoreceptor such as a photosensitive drum, or photosensitive belt, develops the latent electrostatic image with toners of predetermined different colors and then forms a desired image by transferring the developed image to a recording paper. Such printing devices are classified into dry type and wet type devices according to the type of toner used. In the case of the dry type device, toner in a powder state is used, and in the case of the wet type device, liquid ink in which volatile liquid carrier is mixed with a toner is used. Since the wet type device exhibits a higher quality print than the dry type device, and, in addition, inhaling harmful toner dust can be prevented in the wet type device, the wet type device is being used increasingly.

FIG. 1 shows a schematic diagram illustrating the structure of a conventional printing device.

Referring to FIG. 1, a conventional printing device comprises a photosensitive belt 10 installed along a continuous loop track, a driving roller 11 for circulating the photosensitive belt 10 along the given track, a backup roller 12, and a tension roller 13.

A main charger 20 is provided over one side of the photosensitive belt 10 for charging one surface of the photosensitive belt 10 to a predetermined voltage. In addition, laser scanning units 30 each for irradiating a laser beam on the photosensitive belt 10 to form a latent electrostatic image, and developing units 40 each for developing the latent electrostatic image to form a toner image by applying an ink of a toner of a predetermined color and a liquid carrier to the region where the latent electrostatic image is formed are installed under the photosensitive belt 10. The plurality of laser scanning units 30 and the plurality of developing units 40 are installed for color printing so that latent electrostatic images corresponding to the respective colors can be developed as shown in FIG. 1.

The ink thus applied to the photosensitive belt 10 by the developing units 40 is dried by a drying roller 51 and heating rollers 52, and accordingly the liquid carrier contained in the toner image is removed. The toner image is transferred to a recording paper P by a transfer roller 61 installed parallel to the backup roller 12 with the photosensitive belt 10 therebetween. The recording paper P is supplied between the transfer roller 61 and a fixing roller 62 installed with a predetermined space from the transfer roller 61 to be parallel to the transfer roller 61, and the toner image, which is transferred to the recording paper, is heated and pressed by the fixing roller 62 and is fixed to the recording paper P to form a desired image.

On the other hand, the toner image transferred to the transfer roller 61 is not completely transferred to the recording paper P in the transfer step, and the transfer roller 61 on which a minute quantity of toner particle remains may perform the following transfer job. In addition, micro-dirts, dust particles, or the like may adhere to the surface of the transfer roller 61 in a paper P transferring step. Since such remaining toner particles, i.e., waste ink, microscopic dirt, or dust particles stain the surface of the transfer roller 61, there is a problem in which as printing operations are repeated, it is difficult to form a clear and crisp image on the recording paper. In addition, when a paper jam in which a recording paper P is abnormally inserted between rollers or a similar problem occurs, the operation of the printing device is stopped, and accordingly the toner image on the surface of the transfer roller 61 is not completely transferred to the recording paper P and remains on the transfer roller 61. Since the toner image thus remaining on the surface of the transfer roller 61 stains the next recording paper, there is a problem in which recording papers are unnecessarily consumed.

SUMMARY OF THE INVENTION

To solve the above problems, it is an objective of the present invention to provide an apparatus for cleaning a transfer roller and an optical photoreceptor of a printing device, which is capable of removing waste ink or the like remaining on the transfer roller so as to enhance the quality of an image.

Accordingly, to achieve the above objective, there is provided an apparatus for cleaning a transfer roller and an optical photoreceptor of a printing device, which is operative to clean the transfer roller for transferring a toner image formed on the optical photoreceptor to a recording paper, comprising: a cleaning roller installed to closely contact an outer circumferential surface of the transfer roller and to be rotatable; a heat source installed in the cleaning roller for heating an outer circumferential surface of the cleaning roller; and a cleaning roller moving mechanism which causes the cleaning roller either to contact or be separated from the outer circumferential surface of the transfer roller.

According to a preferred embodiment of the present invention, the cleaning roller moving mechanism includes: an inner frame for rotatably supporting both side portions of the rotating shaft of the cleaning roller; an outer frame installed outside the inner frame so that the position of the outer frame is fixed with respect to the transfer roller, and provided with slots so that both side portions of the rotating shaft of the cleaning roller can be inserted through the slots and move in a direction perpendicular to the lengthwise direction of the cleaning roller within a predetermined distance; elastic members installed between the inner and outer frames for applying elastic forces to the inner frame so as to cause the inner frame to move toward the transfer roller and to cause the cleaning roller to contact the outer circumferential surface of the transfer roller; a first driving gear joined to a first driving motor installed at a side of the outer frame; and a cam gear installed at the outer frame so as to mesh with the first driving gear and be rotated, and, according to the rotation thereof, causing the rotating shaft of the cleaning roller to be separated from the transfer roller at a predetermined distance.

In addition, according to another preferred embodiment of the present invention, the apparatus further comprises a waste ink removing mechanism which removes waste ink on the outer circumferential surface of the cleaning roller.

The waste ink removing mechanism includes: a cutter member which contacts the outer circumferential surface of the cleaning roller and removes waste ink on the outer circumferential surface of the cleaning roller; a cleaning roller driving mechanism which rotates the cleaning roller in one direction; a cutter member traversing mechanism which supports the cutter member and traverses the cutter member in a lengthwise direction of the cleaning roller; and a discharge mechanism provided below the cutter member which collects and discharges the waste ink which is removed by the cutter member from the surface of the cleaning roller.

In addition, it is preferable that the waste ink removing mechanism further includes a cutter member moving mechanism which the cutter member to contact or be separated from the outer circumferential surface of the cleaning roller.

The cutter member traversing mechanism comprises: a first bracket supporting one end of the cutter member; a lead screw which is installed to be parallel to the cleaning roller with a predetermined space and on which the first bracket is installed, and which is rotated by a predetermined driving mechanism to traverse the first bracket and the cutter member linearly.

The discharge mechanism includes: a rotary discharge device comprising a feeder case installed to be parallel to the traverse direction of the cutter member and having an opening at the upper portion thereof, and a rotary feeder installed in the feeder case to be rotatable for pushing the waste ink falling into the feeder case in one direction; and a waste ink box provided at an end of the feeder case from which waste ink is discharged, and installed in the printing device to be removable.

BRIEF DESCRIPTION OF THE DRAWINGS

The above objective and advantages of the present invention will become more apparent by describing in detail preferred embodiments thereof with reference to the attache drawings, in which.

DESCRIPTION OF THE PREFERRED EMBODIMENTS

Figure 1:
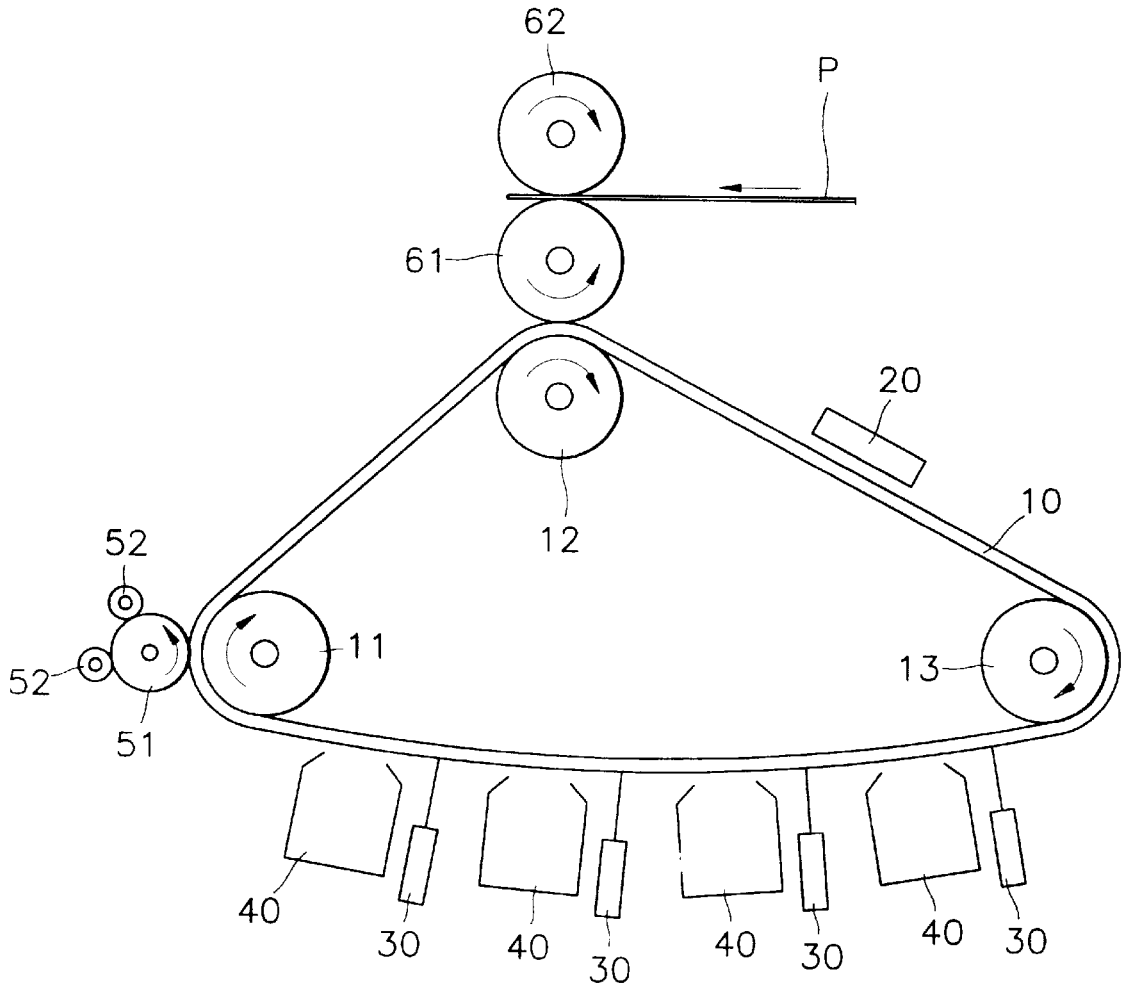
FIG. 1 (PRIOR ART)
FIG. 1 is a schematic diagram illustrating the structure of a conventional printing device.
Figure 2:
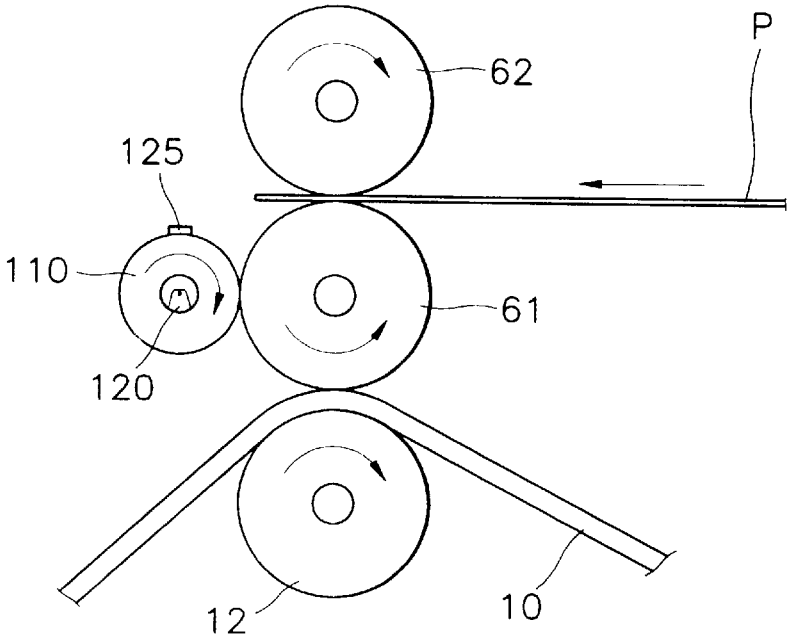
FIG. 2 is a schematic diagram illustrating a portion of a printing device to which an apparatus for cleaning a transfer roller and an optical photoreceptor according to the present invention is applied.

FIG. 2 shows a portion of a printing device to which an apparatus for cleaning a transfer roller and an optical photoreceptor according to the present is applied. Here, reference numeral 12 denotes a backup roller, and reference numeral 62 denotes a fixing roller.

As shown in FIG. 2, an apparatus for cleaning a transfer roller and an optical photoreceptor according to the present invention is intended to clean a transfer roller 61 which transfers a toner image formed on a photosensitive belt 10 of a printing device to a recording paper P, and is provided with a cleaning roller 110 installed to rotate while contacting the outer circumferential surface of the transfer roller 61. In addition, a heat source 120 for heating the outer circumferential surface of the cleaning roller 110 is installed in the cleaning roller 110, and a cleaning roller moving mechanism which moves the cleaning roller 110 to contact or be separated from the outer circumferential surface of the transfer roller 61 is provided.

The cleaning roller 110 contacts the outer circumferential surface of the transfer roller 61, is rotated by the rotation of the transfer roller 61, and cleans the outer circumferential surface of the transfer roller 61. In addition, a coating film usually made of a material having a surface energy higher than that of the outer circumferential surface of the transfer roller 61, for example aluminum oxide ($Al_2O_3$), a synthetic resin, or rubber material is formed on the outer circumferential surface of the cleaning roller 110.

Therefore, waste ink, such as toner particles not completely transferred to the recording paper P and remaining on the transfer roller 61, moves and adheres to the surface of the cleaning roller 110 having a surface energy higher than that of the transfer roller 61, and is therefore removed from the transfer roller 61. At this time, foreign materials such as microscopic dirt and dust particles freed from the recording paper P and adhering to the transfer roller 61 during the transfer of the recording paper P move and adhere to the surface of the cleaning roller 110 due to the difference in surface energy levels, and therefore the operation of cleaning the transfer roller 61 is accomplished. Also, waste ink remaining on the surface of the transfer roller 61 when a recording paper jam occurs moves and adheres to the surface of the cleaning roller 110, and therefore a problem of staining of the next recording paper supplied after the paper jam can be solved. Thus, even though the transfer roller 61 rotates continuously, foreign materials and waste ink once moved from the transfer roller 61 and adhering to the cleaning roller 110 does not return and adhere back to the transfer roller 61 due to the difference in the surface energy levels thereof.

In addition, the cleaning roller 110 is heated to a predetermined temperature by the heat source 120 so as to enhance the efficiency of cleaning. While the temperature of the photosensitive belt 10 is usually maintained below 45° C., the surface temperature of the transfer roller 61 is maintained at about 80° C., and the surface temperature of the cleaning roller 110 is maintained at about 100° C. which is 10~20° C. higher than that of the transfer roller 61. Therefore, waste ink moving and adhering to the outer circumferential surface of the cleaning roller 110 is maintained in a sticky state to enhance the efficiency of cleaning. Thus, the temperature of the outer circumferential surface of the cleaning roller 110 needs to be maintained at an appropriate temperature, and to this end, a temperature sensor 125 may be installed to contact the outer circumferential surface of the cleaning roller 120. The temperature sensor 125 senses the temperature of the outer circumferential surface of the cleaning roller 120, the heat source 120 is controlled according to the sensed temperature so that the temperature of the outer circumferential surface of the cleaning roller 120 can be maintained at an appropriate temperature.

On the other hand, the cleaning roller moving mechanism causes the cleaning roller 110 to contact the outer circumferential surface of the transfer roller 61 so as to allow the cleaning roller 110 to perform the cleaning operation during the printing operation, and, before and after the printing operation, serves to separate the cleaning roller 110 from the transfer roller at a predetermined distance so as to prevent the cleaning roller 110 and the transfer roller 61 from sticking to each other due to sludge. Such a cleaning roller moving mechanism will be described below.

Figure 3:
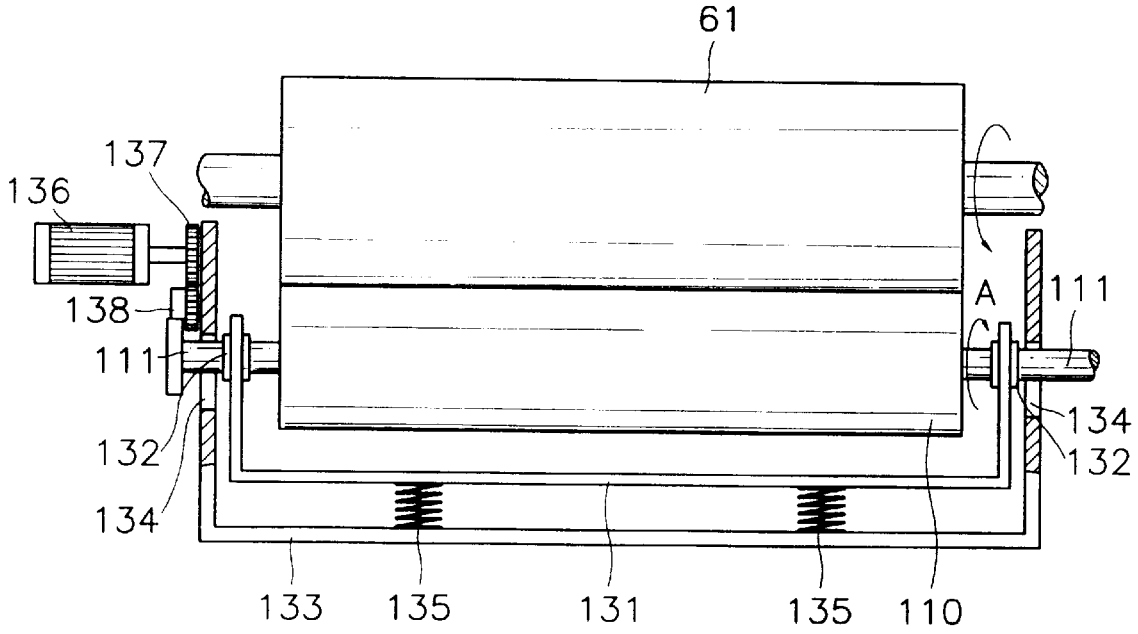
FIG. 3 is a plan view illustrating a cleaning roller moving mechanism for moving a cleaning roller of the apparatus for cleaning a transfer roller and an optical photoreceptor according to the present invention.
Figure 4:
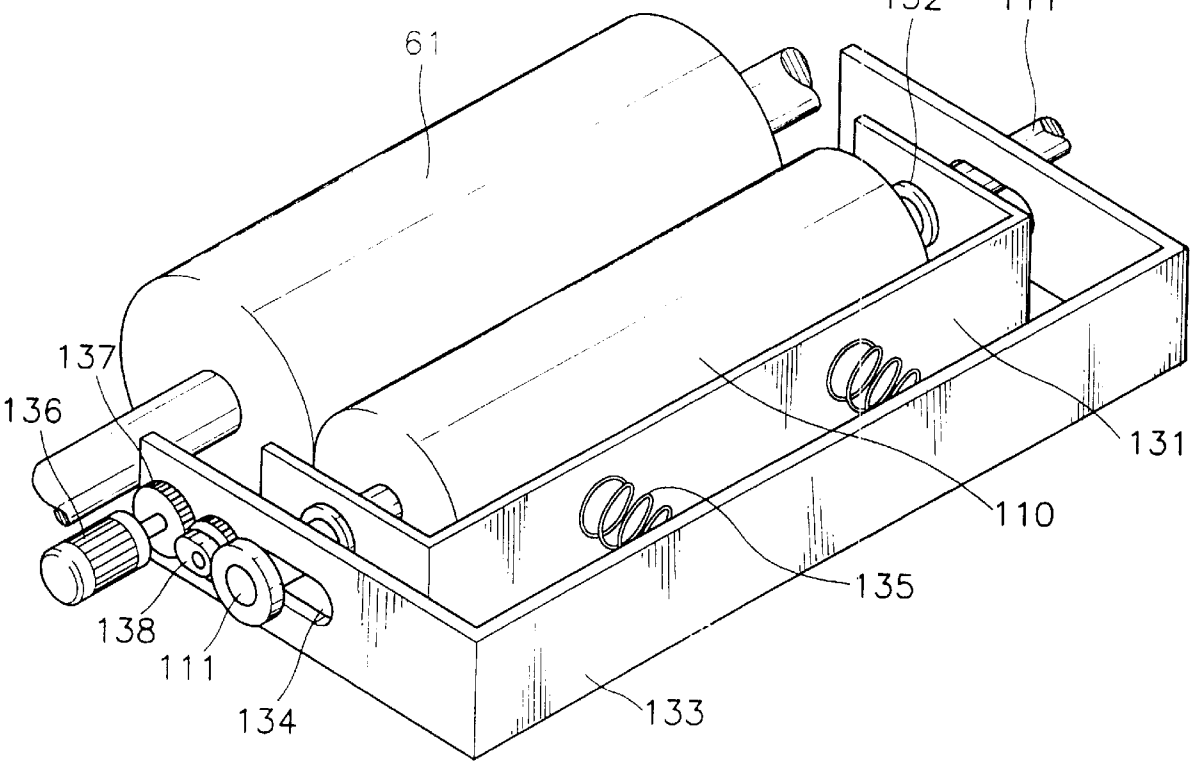
FIG. 4 is a perspective view illustrating the cleaning roller moving mechanism shown in FIG. 3

FIG. 3 is a plan view illustrating a cleaning roller moving mechanism for moving a cleaning roller of the apparatus for cleaning a transfer roller and an optical photoreceptor according to the present invention, and FIG. 4 is a perspective view illustrating the cleaning roller moving mechanism shown in FIG. 3.

Referring to FIGS. 3 and 4, the cleaning roller moving mechanism comprises an inner frame 131, an outer frame 133, elastic members such as compression coil springs 135, a first driving motor 136 and a first driving gear 137, and a cam gear 138.

The inner frame 131 serves to rotatably support both side portions of the rotating shaft 111 via bearings 132, and is configured to move with the cleaning roller 110 in a direction perpendicular to the lengthwise direction of the cleaning roller 110 within a predetermined distance.

The outer frame 133 is installed outside of the inner frame 131 so that the position thereof can be fixed with respect to the transfer roller 61. In addition, slots 134 are provided at the outer frame 133 so that both side portions of the rotating shaft 111 of the cleaning roller 110 can be inserted into the slots 134, and the cleaning roller 110 can move in a direction perpendicular to the lengthwise direction of the cleaning roller 110 within the predetermined distance along the slots 134.

Compression coil springs 135 are installed between the inner and outer frames 131 and 133. The compression coil springs 135 apply elastic forces to the inner frame 131 to cause the inner frame 131 to move toward the transfer roller 61. Accordingly, while the cleaning roller 110 contacts the outer circumferential surface of the transfer roller 61 and rotates in the direction of arrow A, the outer circumferential surface of the transfer roller 61 can be cleaned.

The first driving motor 136 and the first driving gear 137 are installed at a side of the outer frame 133, and rotate the cam gear 138. The cam gear 138 is installed so as to mesh with the first driving gear 137 and rotate. After the printing operation, the first driving motor 136 is operated to rotate the cam gear 138, and the cam gear 138 moves the rotating shaft 111 of the cleaning roller 110 while rotating. Accordingly, the cleaning roller 110 overcomes the elastic forces of the compression coil springs 135 and is spaced a predetermined distance from the transfer roller 61.

According to the cleaning roller moving mechanism having such a structure, during the printing operation, the cleaning roller 110 contacts the outer circumferential surface of the transfer roller 61 due to the compression coil springs 135, and before and after the printing operation the cleaning roller is spaced a predetermined distance from the transfer roller 61 due to the rotation of the cam gear 138.

Figure 5:
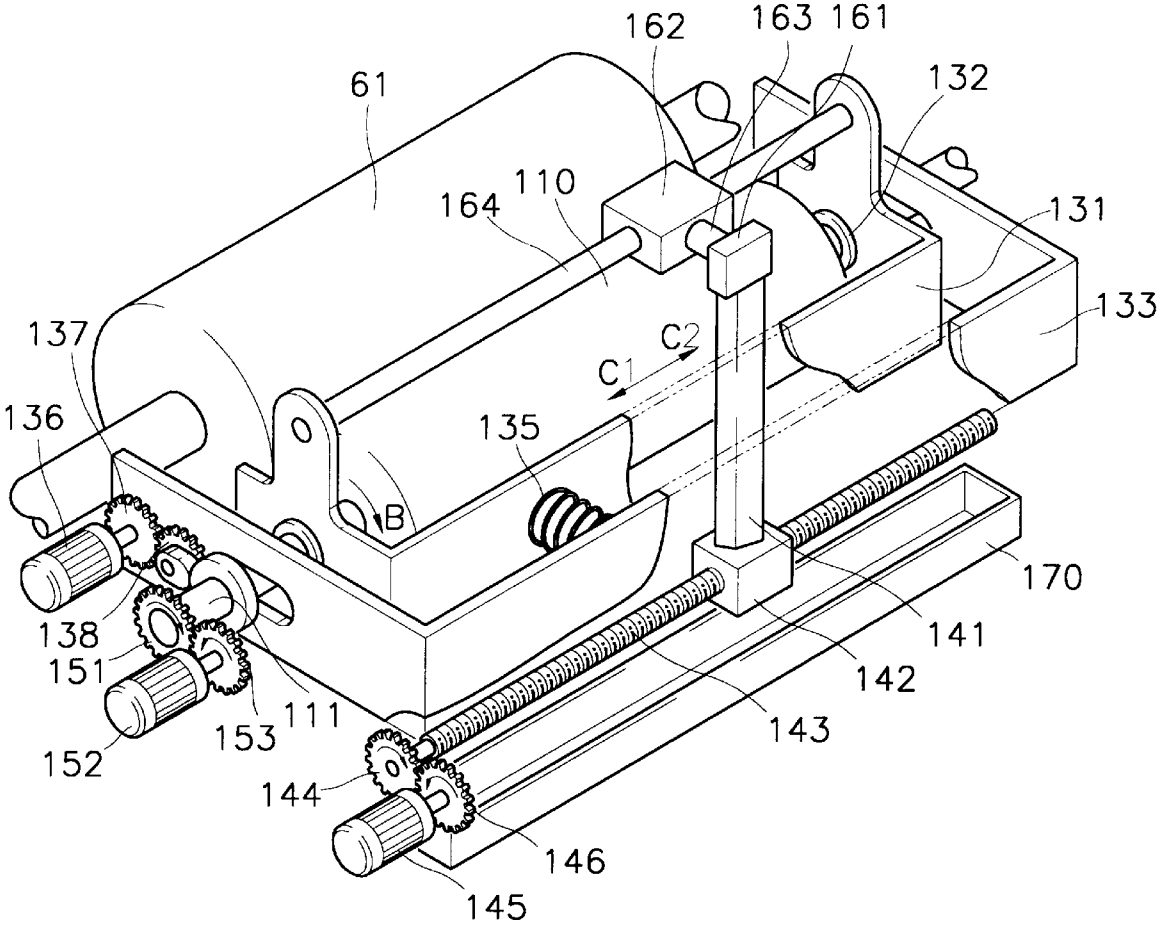
FIG. 5 is a perspective view illustrating an apparatus for cleaning a transfer roller and an optical photoreceptor, which is provided with a waste ink removing mechanism.

On the other hand, since the cleaning efficiency may be lowered due to saturation of the waste ink transferred from the transfer roller 61 on the outer circumferential surface of the cleaning roller 110 when the number of printed papers exceeds a certain number, in order to prevent this, it is preferable that the waste ink on the outer circumferential surface of the cleaning roller 110 is removed periodically. To this end, a waste ink removing mechanism is provided for removing the waste ink on the outer circumferential surface of the cleaning roller 110, and FIG. 5 shows an apparatus for cleaning a transfer roller and an optical photoreceptor, which is provided with the above waste ink removing mechanism. Structural elements similar to those illustrated for the previous embodiment are designated by the same reference numerals.

As shown in FIG. 5, the waste ink removing mechanism comprises a cutter member 141, a cleaning roller driving mechanism for rotating the cleaning roller 110, a cutter member traversing mechanism, and a discharge mechanism. In addition, it is preferable that the waste ink removing mechanism further includes a cutter member moving mechanism. In addition, the waste ink on the surface of the cleaning roller 110 is removed before and after the printing operation, i.e., when the cleaning roller 110 is separated to a predetermined distance from the transfer roller 61 by the cam gear 138.

Figure 6:
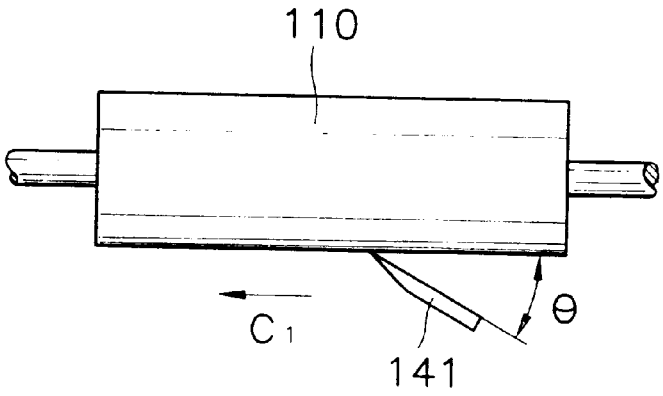
FIG. 6 is a front view illustrating a state of contacting the cleaning roller shown in FIG. 5 with a cutter member.

The cutter member 141 is installed between the cleaning roller 110 and the inner frame 131, and serves to contact the surface of the cleaning roller 110 and remove the waste ink that moves from the transfer roller 61 and adheres to the surface of the cleaning roller 110. As shown in FIG. 6, the cutter member 141 moves in a lengthwise direction (the direction of arrow C1) of the cleaning roller 110 while contacting the surface of the cleaning roller 110 at a predetermined contact angle θ, and removes the waste ink on the surface of the cleaning roller 110. At this time, it is preferable that the contact angle θ is maintained at an angle between about 20° and 30° so as to achieve a high efficiency of removing the waste ink. In addition, since solidifying the waste ink allows the cutter member to easily remove the waste ink, it is preferable that the outer circumferential surface of the cleaning roller 110 is cooled below about 40° C. by breaking the power source of the heat source 120 (FIG. 2).

Again, referring to FIG. 5, the cleaning roller driving mechanism serves to rotate the cleaning roller 110 so that all the waste ink on the entire outer circumferential surface of the cleaning roller 110 can be removed. To this end, a first driven gear 151 is installed on one end of the rotating shaft 111 of the cleaning roller 110, a second driving motor 152 and a second driving gear 153 are provided for rotating the first driven gear 151. In addition, the second driving gear 153 is installed so as to mesh with the first driven gear 151 when the cleaning roller 110 is separated from the transfer roller 61 by the cam gear 138. Therefore, the cleaning roller 110 is rotated by the second driving motor 152 in the direction of arrow B only before and after the printing operation. At this time, it is preferable that a stepper motor is used as the second driving motor 152 so as to rotate the cleaning roller 110 in steps. In addition, the second driving motor 152 may assume the role of the first driving motor 136 so as to reduce the installation space and the power consumption thereof.

In addition, the cutter member traversing mechanism serves to support the cutter member 141 and traverse the cutter member 141 in a lengthwise direction of the cleaning roller 110, and comprises a first bracket 142 and a lead screw 143.

The lower end of the cutter member 141 is joined to and supported by the first bracket 142. The lead screw 143 is installed to be parallel to the cleaning roller 110 with a predetermined space, and a second driven gear 144 is installed on one end of the lead screw 143. The second driven gear 144 meshes with a third driving gear 146 joined to a third driving motor 145 to be rotated. The first bracket 142 is installed on the lead screw 143, and is moved linearly by the rotation of the lead screw 143 in a lengthwise direction of the cleaning roller 110 (the direction of arrow C1). Accordingly, the cutter member 141 supported by the first bracket 142 is also moved in the same direction and removes the waste ink on the surface of the cleaning roller 110.

The discharge mechanism is provided below the cutter member 141, and is intended to collect and discharge waste ink which is removed from the surface of the cleaning roller 110 by the cutter member 141 and falls. It is preferable that a waste ink box 170 which is installed in the printing device to be removable is used as the discharge mechanism. Therefore, when the waste ink box 170 is filled with waste ink, the waste ink box 170 is removed from the printing device and the inside of the waste ink box 170 can be cleaned.

On the other hand, the cutter member moving mechanism serves to cause the cutter member 141 to contact or be separated from the surface of the cleaning roller 110, and comprises a second bracket 161, a solenoid 162 and a guide rail 164.

The upper end of the cutter member 141 is joined to and supported by the second bracket 161, and a rod 163 of the solenoid 162 is joined to one side of the second bracket 161.

The guide rail 164 is installed to be parallel to the cleaning roller 110 with a predetermined space, and both ends of the guide rail 164 are fixed to the inner frame 131. In addition, the solenoid 162 is installed on the guide rail 164.

Accordingly, the solenoid 162 is guided by the guide rail 164, and is linearly moved in a lengthwise direction of the cleaning roller 110 (the direction of arrow C1 or C2).

The solenoid 164 moves the second bracket 161 joined to the rod 163 back and forth in a direction perpendicular to the lengthwise direction of the cleaning roller 110 by moving the rod 163 back and forth. Accordingly, the cutter member 141 contacts the surface of the cleaning roller 110 with a predetermined pressing force, and is separated from the surface of the cleaning roller 110. In other words, when the cutter member 141 moves in the direction of arrow C1 and removes waste ink, the solenoid 162 causes the cutter member 141 to contact the surface of the cleaning roller 110 with the predetermined pressing force, and when the cutter member 141 moves in the direction of arrow C2 and returns to its original position, the solenoid 162 causes the cutter member 141 to be separated from the surface of the cleaning roller 110.

Figure 7:
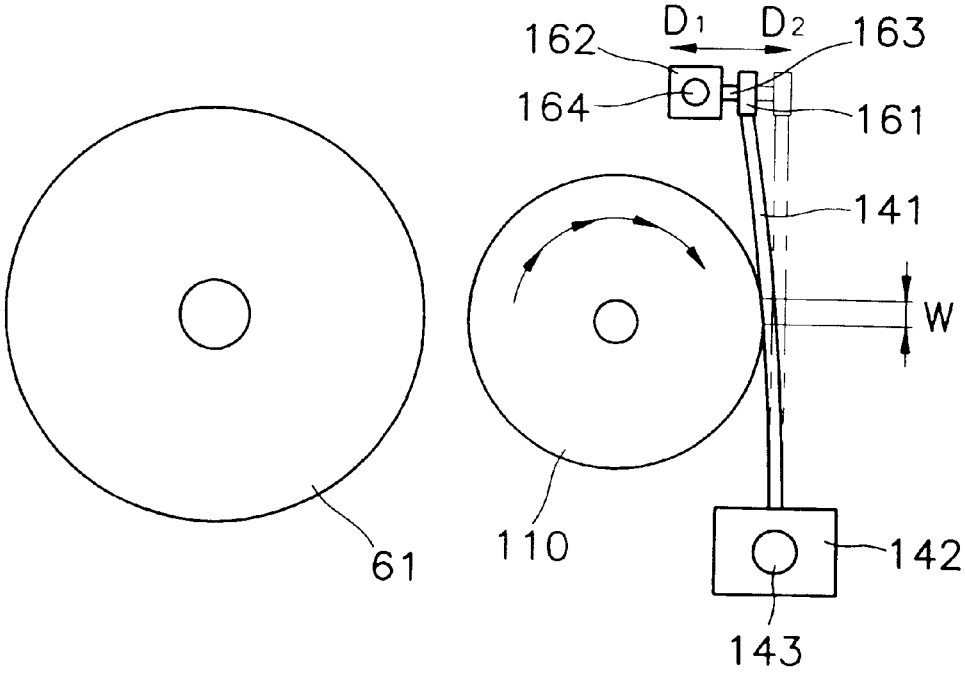
FIG. 7 is a side view for describing the operation of a solenoid shown in FIG. 5.

FIG. 7 is a side view for describing the operation of the solenoid shown in FIG. 5.

As shown in FIG. 7, the cutter member 141 is caused to contact or be separated from the surface of the cleaning roller 110 by the solenoid. That is, when waste ink on the surface of the cleaning roller 110 is removed, the solenoid 162 moves the rod 163 backward and pulls the upper end of the cutter member 141 joined to the second bracket 161 in a direction toward the center of the cleaning roller 110 (the direction of arrow D1), and therefore causes the cutter member 141 to contact the surface of the cleaning roller 110 with a predetermined pressing force. At this time, the solenoid 162 applies a pressing force to the cutter member so that the contact width W of the cleaning roller with the cutter member 141 can be wider than about 2 mm. When the contact width W is too wide, the movement of the cutter member in the lengthwise direction of the cleaning roller 110 is hindered because the pressing force is too strong. On the other hand, since the efficiency of removing the waste ink is lowered, it is preferable that the contact width W is not too narrow. Thus, when the lead screw 143 rotates with the cutter member contacting the surface of the cleaning roller 110, the first bracket 142 is moved linearly in a lengthwise direction of the cleaning roller 110, and since the cutter member 141 is moved accordingly in the same direction, waste ink adhering to the surface of the cleaning roller 110 is removed by the cutter member 141. At this time, the solenoid 162 is moved along the guide rail 164 in the same direction by the movement of the cutter member 141.

On the other hand, when the cutter member 141 is returned to the original position, the solenoid 162 pushes the upper end of the cutter member 141 in the direction of arrow D2 to cause the cutter member 141 to be separated from the surface of the cleaning roller 110 with a predetermined space.

Thus, when waste ink on a portion of the cleaning roller 110 is removed by the cutter member 141, the cleaning roller 110 is rotated in the direction of arrow B by a predetermined angle by the above-described cleaning roller driving mechanism with the cleaning roller 110 separated from the transfer roller 61 with the predetermined space. Again, waste ink is repeatedly removed by the cutter member 141, and therefore waste ink on the entire surface of the cleaning roller 110 can be removed.

As described above, when the apparatus for cleaning a transfer roller and an optical photoreceptor of a printing device according to the present invention is provided with the waste ink removing mechanism for removing waste ink on the surface of the cleaning roller, the lowering of cleaning efficiency which occurs due to the accumulation of the printing operation can be prevented, and therefore the quality of print can be enhanced. In addition, the period of replacing a cleaning roller can be prolonged or replacement of a cleaning roller can be obviated.

Figure 8:
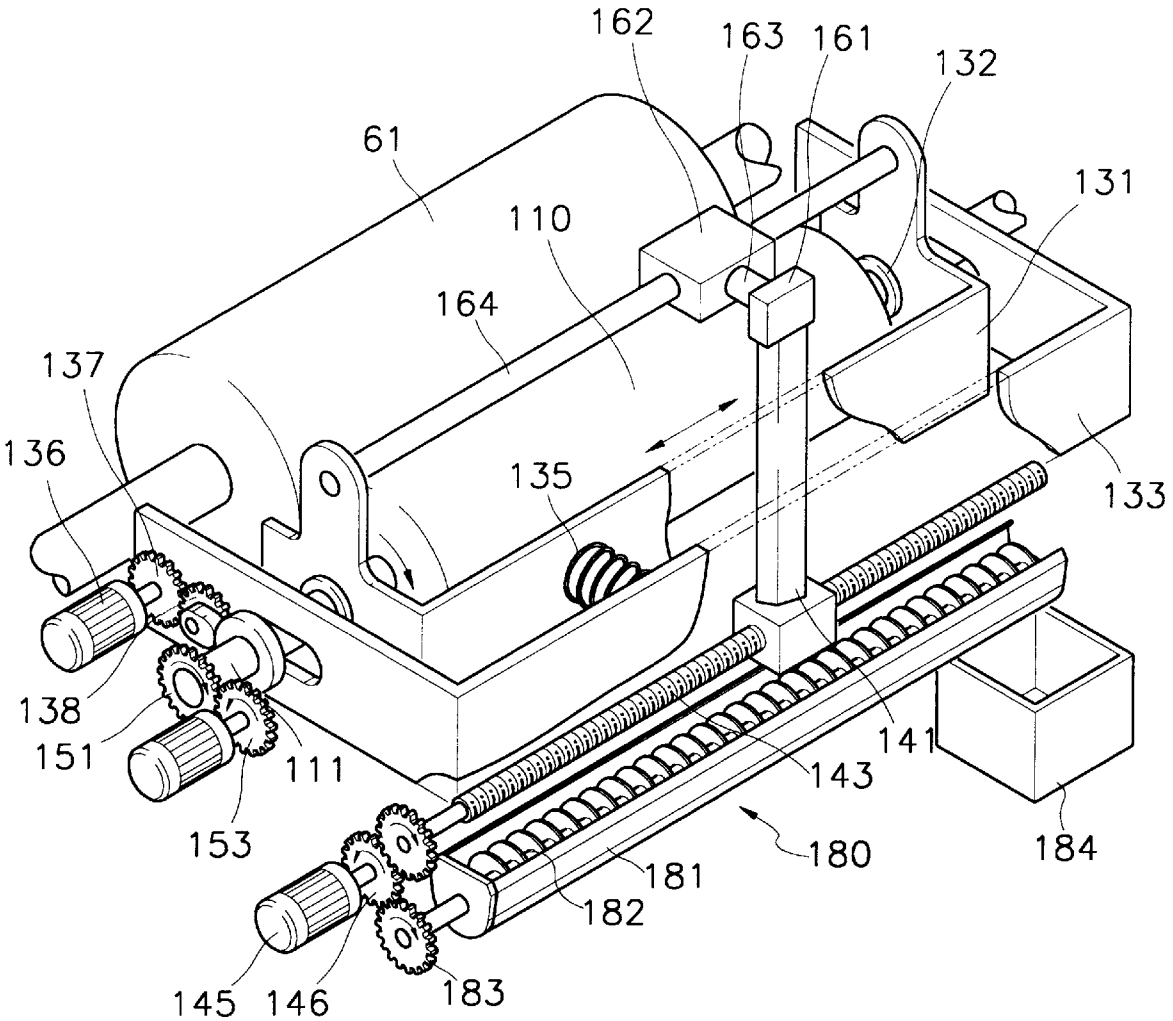
FIG. 8 is a perspective view illustrating an apparatus for cleaning a transfer roller and an optical photoreceptor, which is provided with a rotary discharge device.

FIG. 8 is a perspective view illustrating an apparatus for cleaning a transfer roller and an optical photoreceptor, which is provided with a rotary discharge device as another embodiment of a discharge mechanism. Again, identical structural elements as described in previous embodiments are designated with the same reference numerals.

As shown in FIG. 8, a rotary discharge device 180 may be provided as the discharge mechanism. The rotary discharge device 180 comprises a feeder case 181, and a rotary feeder 182. The feeder case 181 is installed below the cutter member 141 to be parallel to the traverse direction of a cutter member 141, and has a semicylindrical shape the upper portion of which is provided with an opening. Therefore, waste ink removed by the cutter member 141 falls into the feeder case 181 through the opening. The rotary feeder 182 is rotatably installed in the feeder case 181, and pushes the waste ink falling into the feeder case 181 in one direction. A third driven gear 183 is installed at one end of the rotary feeder 182, and the third driven gear 183 meshes with a third driving gear 146 joined to a third driving motor 145 to be rotated. Thus, the third driving motor 145 can be used to rotate both a lead screw 143 and the rotary feeder 182.

In addition, a waste ink box 184 for collecting the waste ink discharged by the rotary feeder 182 is installed at one end portion of the feeder case 181, i.e., the end portion to which the waste ink is discharged. The waste ink box 184 is installed in a printing device to be removable, and when the waste ink box is filled with waste ink, the waste ink box 184 is removed from the printing device, and the inside thereof can be cleaned.

As described above, according to the apparatus for cleaning a transfer roller and a photoreceptor of a printing device according to the present invention, foreign materials, waste ink and the like remaining on an optical photoreceptor and a transfer roller can be recovered by a cleaning roller which rotates while closely contacting the transfer roller, and by providing a waste ink removing mechanism which removes waste ink adhering to the surface of the cleaning roller, lowering of the cleaning efficiency which occurs due to the accumulation of the printing operations can be prevented, and therefore the quality of prints can be enhanced. In addition, since the period of replacing a cleaning roller can be prolonged or replacement of a cleaning roller can be obviated, there is an effect in that the cost of maintaining a printing device can be reduced.

Although the invention has been described with reference to preferred embodiments thereof in connection with the accompanying drawings for the purposes of illustration, it should be understood that various modifications and equivalents may be made by those skilled in the art without departing from the spirit and scope of the invention. Accordingly, it must be understood that the invention is limited only by the attached claims.

What is claimed is:

1. An apparatus for cleaning a transfer roller of a printing device, which is operative to clean the transfer roller for transferring a toner image formed on an optical photoreceptor to a recording paper, comprising a cleaning roller installed to closely contact an outer circumferential surface of the transfer roller to be rotatable;

a heat source installed in the cleaning roller for heating an outer circumferential surface of the cleaning roller; and a cleaning roller moving mechanism which causes the cleaning roller either to contact or be separated from the outer circumferential surface of the transfer roller.

2. The apparatus as claimed in claim 1, wherein the outer circumferential surface of the cleaning roller is made of a material having a higher surface energy than that of the outer circumferential surface of the transfer roller.

3. The apparatus as claimed in claim 1, wherein a temperature sensor for sensing the temperature of the outer circumferential surface of the cleaning roller is installed to contact the outer circumferential surface of the cleaning roller so that the temperature of the outer circumferential surface of the cleaning roller is maintained at a predetermined temperature.

4. The apparatus as claimed in claim 3, wherein the surface temperature of the cleaning roller is maintained at a temperature higher than that of the transfer roller, and the surface temperature of the transfer roller is maintained at a temperature higher than a temperature of the optical photoreceptor.

5. The apparatus as claimed in claim 4, wherein the temperature of the optical photoreceptor is lower than 45° C., the surface temperature of the transfer roller is about 80° C., and the surface temperature of the cleaning roller is 10~20° C. higher than that of the transfer roller.

6. The apparatus as claimed in claim 1, wherein the cleaning roller moving mechanism includes:

an inner frame for rotatably supporting both side portions of the rotating shaft of the cleaning roller;

an outer frame installed outside the inner frame so that the position of the outer frame is fixed with respect to the transfer roller, and provided with slots so that both side portions of the rotating shaft of the cleaning roller can be inserted through the slots and move in a direction perpendicular to a lengthwise direction of the cleaning roller within a predetermined distance;

elastic members installed between the inner and outer frames for applying elastic forces to the inner frame so as to cause the inner frame to move toward the transfer roller and to cause the cleaning roller to contact the outer circumferential surface of the transfer roller;

a first driving gear joined to a first driving motor installed at a side of the outer frame; and a cam gear installed at the outer frame so as to mesh with the first driving gear and be rotated, and, according to the rotation thereof, causing the rotating shaft of the cleaning roller to be separated from the transfer roller at a predetermined distance.

7. The apparatus as claimed in claim 1, further comprising a waste ink removing mechanism which removes waste ink on the outer circumferential surface of the cleaning roller.

8. The apparatus as claimed in claim 7, wherein the waste ink removing mechanism includes:

a cutter member which contacts the outer circumferential surface of the cleaning roller and removes waste ink on the outer circumferential surface of the cleaning roller;

a cleaning roller driving mechanism which rotates the cleaning roller in one direction;

a cutter member traversing mechanism which supports the cutter member and traverses the cutter member in a lengthwise direction of the cleaning roller; and a discharge mechanism provided below the cutter member which collects and discharges the waste ink which is removed by the cutter member from the surface of the cleaning roller.

9. The apparatus as claimed in claim 8, wherein a contact angle θ of the cutter member is 20°~30° with respect to the cleaning roller.

10. The apparatus as claimed in claim 8, wherein the cleaning roller driving mechanism comprises:

a second driving gear joined to a second driving motor; and a first driven gear which is installed on a side portion of the rotating shaft of the cleaning roller, and meshes with the second driving gear and is rotated when the cleaning roller is separated from the transfer roller.

11. The apparatus as claimed in claim 8, wherein the cutter member traversing mechanism comprises:

a first bracket supporting one end of the cutter member;

a lead screw which is installed to be parallel to the cleaning roller with a predetermined space and on which the first bracket is installed, and which is rotated by a predetermined driving mechanism to traverse the first bracket and the cutter member linearly.

12. The apparatus as claimed in claim 8 or 11, wherein the waste ink removing mechanism further includes a cutter member moving mechanism which causes the cutter member to contact or be separated from the outer circumferential surface of the cleaning roller.

13. The apparatus as claimed in claim 12, wherein the cutter member moving mechanism comprises:

a second bracket supporting the other end of the cutter member;

a solenoid for causing the cutter member to contact the surface of the cleaning roller with a predetermined pressing force or to be separated from the surface of the cleaning roller by moving the second bracket back and forth in a direction perpendicular to a lengthwise direction of the cleaning roller; and a guide rail which is installed to be parallel with the cleaning roller with a predetermined space and on which the solenoid is installed, and which guides the linear movement of the solenoid in the lengthwise direction of the cleaning roller.

14. The apparatus as claimed in claim 13, wherein the solenoid causes the cutter member to contact the cleaning roller so that the contact width W of the cutter member with the cleaning roller is substantially wider than 2 mm.

15. The apparatus as claimed in claim 8, wherein the discharge mechanism is a waste ink box installed in the printing device to be removable.

16. The apparatus as claimed in claim 8, wherein the discharge mechanism includes:

a rotary discharge device comprising a feeder case installed to be parallel to the traverse direction of the cutter member and having an opening at the upper portion thereof, and a rotary feeder installed in the feeder case to be rotatable for pushing the waste ink falling into the feeder case in one direction; and a waste ink box provided at an end of the feeder case from which waste ink is discharged, and installed in the printing device to be removable.

* * * * *